US011564413B2

(12) United States Patent
Holmes et al.

(10) Patent No.: US 11,564,413 B2
(45) Date of Patent: Jan. 31, 2023

(54) ITEM HOLDER

(71) Applicant: Brian P. Holmes, Canton, MI (US)

(72) Inventors: Brian P. Holmes, Canton, MI (US); Michael P. Rushing, Waterford, MI (US); Larry G. Rushing, West Bloomfield, MI (US)

(73) Assignee: Brian P. Holmes, Canton, MI (US)

( * ) Notice: Subject to any disclaimer, the term of this patent is extended or adjusted under 35 U.S.C. 154(b) by 202 days.

(21) Appl. No.: 17/005,465

(22) Filed: Aug. 28, 2020

(65) Prior Publication Data

US 2021/0059298 A1 Mar. 4, 2021

Related U.S. Application Data

(60) Provisional application No. 62/893,933, filed on Aug. 30, 2019.

(51) Int. Cl.

| | |
|---|---|
| ***A63B 57/00*** | (2015.01) |
| ***A24F 13/08*** | (2006.01) |
| ***A24F 13/12*** | (2006.01) |
| ***A63B 57/20*** | (2015.01) |
| *A63B 55/60* | (2015.01) |

(52) U.S. Cl.

CPC ..... *A24F 13/08* (2013.01); *A24F 13/12* (2013.01); *A63B 57/0037* (2013.01); *A63B 57/20* (2015.10); *A63B 55/60* (2015.10)

(58) Field of Classification Search

CPC ..... A24F 13/08; A24F 13/12; A63B 57/0037; A63B 57/20; A63B 55/60; A63B 55/10; A63B 57/50; A63B 37/0003; A63B 37/00223; A63B 43/002; A63B 43/008; A63B 43/02; A63B 2210/50; A63B 55/408; A63B 2071/024; A63B 2071/0694; A63B 2209/00; A63B 2225/687

USPC ..... 473/284, 286, 387–408; 224/667, 668, 224/669, 670, 918, 919; 131/190

See application file for complete search history.

(56) References Cited

U.S. PATENT DOCUMENTS

| | | | | |
|---|---|---|---|---|
| 4,273,329 | A * | 6/1981 | Trigg | G01B 3/1084 D10/70 |
| 5,492,230 | A * | 2/1996 | Horton | A63B 55/10 473/282 |
| 5,842,481 | A * | 12/1998 | King | A24F 13/22 428/900 |
| 6,168,061 | B1 * | 1/2001 | Harrison | A63B 47/001 224/919 |
| 6,234,179 | B1 * | 5/2001 | Alcaraz | A24F 13/22 D27/138 |
| 6,234,916 | B1 * | 5/2001 | Carusillo | A63B 55/10 473/286 |
| D450,224 | S * | 11/2001 | Dweck | D7/698 |
| 6,808,095 | B2 * | 10/2004 | Hurtgam | A63B 55/408 473/405 |

(Continued)

*Primary Examiner* — Nini F Legesse

(74) *Attorney, Agent, or Firm* — Howard & Howard Attorneys PLLC

(57) ABSTRACT

An item holder primarily containing two parts: a ball shaped element and a clip. The clip can be seated neatly into a cutout in the ball shaped element. The clip can also be designed as a divot tool or a spike and contains a clamp that can be used to hold a cigar or cigarette, support a golf club or have other uses. The ball shaped element is sized to fit neatly into the ball bracket on any pull cart or motorized cart equipped with such a bracket.

18 Claims, 9 Drawing Sheets

(56) References Cited

U.S. PATENT DOCUMENTS

| | | | | |
|---|---|---|---|---|
| 2006/0070634 | A1* | 4/2006 | Brunkow | A24F 19/0092<br>131/257 |
| 2010/0175233 | A1* | 7/2010 | Breeden | B60P 7/0846<br>24/68 CD |
| 2013/0029774 | A1* | 1/2013 | Davis, Jr. | A63B 55/10<br>473/282 |
| 2014/0349783 | A1* | 11/2014 | Haley | A63B 57/50<br>473/406 |
| 2016/0088962 | A1* | 3/2016 | Koshman | B62J 11/04<br>220/592.16 |

* cited by examiner

ITEM HOLDER

FIELD OF THE INVENTION

The invention relates to the sport of golf and is primarily designed to address issues encountered by the smoking golfer. Secondary functions of the invention involve activities encountered by every golfer, which include holding a club above wet grass and repairing ball marks on the green.

BACKGROUND OF THE INVENTION

The smoking golfer will always be faced with the following dilemma: where do I put my smoke while I'm swinging the club? The item holder of the present invention solves this problem while leveraging the ball bracket equipped on every golf cart on every golf course in the world. Additionally, the invention addresses secondary issues of keeping a club dry in wet conditions and repairing ball marks on the green.

The novel feature can be described by how the invention is secured on the golf cart: the ball fits neatly in the golf cart's ball bracket, and the clip can be removed from the ball to be carried with the golfer when the golfer is inevitably separated from the cart. And in the event the cart's ball bracket doesn't secure the ball tightly, or simply at the golfer's discretion, the clip can be inserted securely into the cart's tee holder in one alternative embodiment.

SUMMARY OF THE INVENTION

The item holder primarily contains two parts: the ball and the clip. The clip can be seated neatly into a cutout in the ball, in the golf cart's tee bracket, or into the ground. In one embodiment, the clip is designed as a divot tool and contains a clamp that can be used to hold a cigar or cigarette or support a golf club. The ball is sized to fit neatly into the ball bracket on any pull cart or motorized cart equipped with such a bracket.

The clip is designed to hold a cigar, cigarette, or any other similarly sized object (pencil, lighter, etc.). The clip is also designed to support a golf club above the turf to avoid moisture on the club.

Current United States Golf Association ("USGA") rules state the minimum diameter of a golf ball is 42.67 mm, but technically there is no maximum size. Aerodynamically, a smaller ball will fly farther than a larger ball. As such, most modern golf balls are manufactured to be as close to this guideline as possible. There are a few notable exceptions:

- Golf balls that are designed for beginners are slightly larger at around 44.2 mm;
- Floating golf balls used at water ranges are slightly larger and slightly lighter . . . these balls would never be used in actual play; and
- The British rule allows for a slightly smaller ball at 41.15 mm.

Since most golf cart ball brackets are designed for the average USGA-compliant ball, the ball described here is designed slightly larger at 42.7 to 43 mm. As such, the ball will fit snuggly into the ball bracket of virtually all golf carts equipped with such a bracket.

The ball has two formats: commercial and custom. The commercial ball resembles a typical golf ball in that it has dimples. The custom ball is smooth and can be imprinted with writing defined by the individual consumer.

Golf cart tee holders are designed for the standard golf tee, which is 4.5 mm in diameter. The spike feature of the clip adheres to this measurement and is 4.5 mm in diameter. As such, the spike feature will fit securely in the tee bracket of any golf cart equipped with this type of bracket.

The clip has the following three functions: hold a cigar or cigarette, hold a club above the wet grass, and repair ball marks on the green. The clip can be seated into the ball for storage or inserted into the turf, depending on the needs of the golfer.

The clip has the following three functions: hold a cigar or cigarette, hold a club above the wet grass, and repair ball marks on the green. Depending on the needs of the golfer, the clip can be seated into the ball for storage, inserted into a golf cart's tee bracket, or inserted into the turf. Though the tee design of the spike is not a traditional forked divot repair tool shape, tools of this design are becoming more popular as they tend not to damage the green as easily as the forked design.

DETAILED DESCRIPTION OF THE INVENTION

Figure 1:
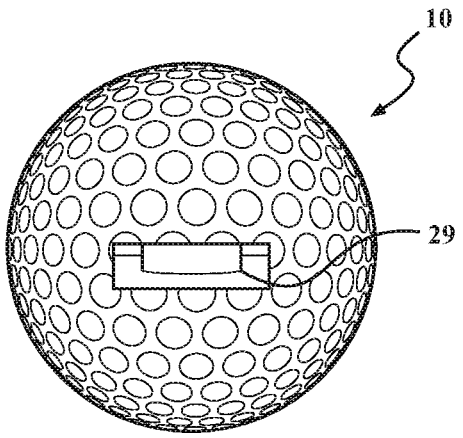
FIG. 1 depicts a ball shaped object that closely resembles an actual dimpled golf ball, with a slot in it.
Figure 3:
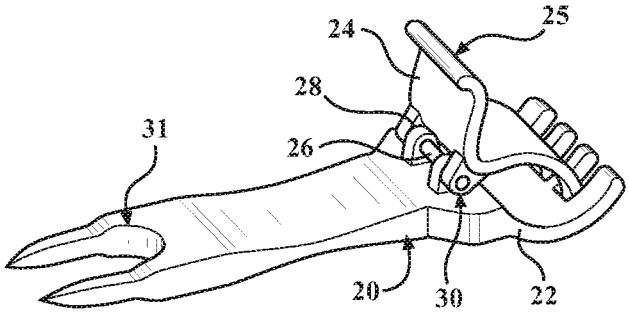
FIG. 3 shows the clip construction. There are four components of the clip: the bottom clip, the top clip, the hinge pin, and the hinge spring. Construction of the clip involves aligning the top and bottom clip at the hinge, inserting the spring between the hinge of the bottom clip, and inserting the hinge pin into the hinge.
Figure 4:
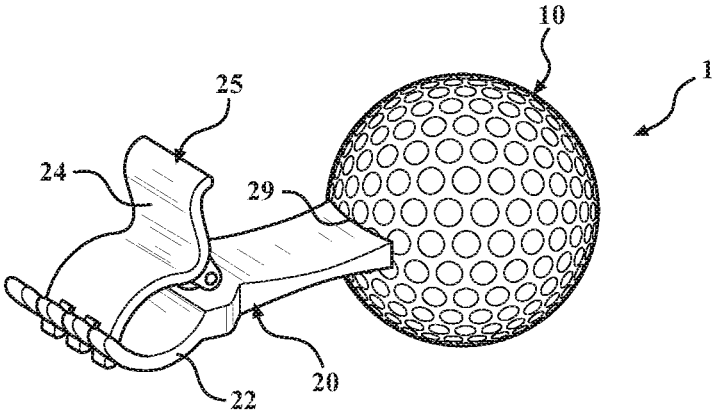
FIG. 4 demonstrates the full item holder assembly.

Referring to FIG. 4 a full item holder assembly 1 is shown, having a ball shaped portion 10 (FIG. 1) and a clip 20 (FIG. 3), including a bottom clip element 22, a top clip element 24, a hinge pin 26, and a hinge spring 28. Construction of the clip 20 involves aligning the top clip element 24 and bottom clip element 22 at the hinge 30, inserting the spring 28 between the bottom clip element 22 and the top clip element 24, and inserting the hinge pin 26 into the hinge 30, as illustrated in FIG. 3. The hinge 30 includes an actuator 25 manually engageable usually by the finger or a thumb of a user to open the hinge 30 to insert an item between the top 24 and bottom 22 clip elements. Release of the actuator 25 moves the top 24 and bottom 22 clip elements towards one another due to the bias of the spring 28 to hold an item between the top 24 and bottom 22 clip elements.

The clip 20 is inserted into a slot 29 in the ball shaped portion 10. The clip 20 may include a divot repair tool 31, which is preferably not exposed when the clip 20 is placed into the slot 29 of the ball shaped portion 10. The divot repair tool 31 may also be used as a spike and inserted into the ground as described below.

Figure 2:
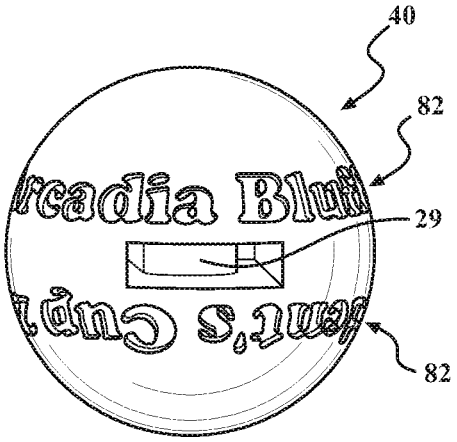
FIG. 2 shows the custom ball with consumer-defined lettering. As shown, the lettering is recessed into the body of the ball. However, this is only to show the outline of the lettering. The actual production version of the ball will have this lettering filled with a color different from the ball and will be flush with the surface of the ball.

FIG. 2 shows a custom ball shaped portion 40 with consumer-defined lettering 42. As shown, the lettering 42 can be recessed into the body of the ball shaped portion. Only the outline of the lettering is illustrated here. The actual production version of the ball shaped portion 40 may have this lettering filled with a color different from the ball shaped portion and may be flush with the surface of the ball shaped portion 40 to be used for a variety of advertising and marketing purposes. The ball shaped portion 40 would also have the slot 29 of FIG. 1.

Figure 5:
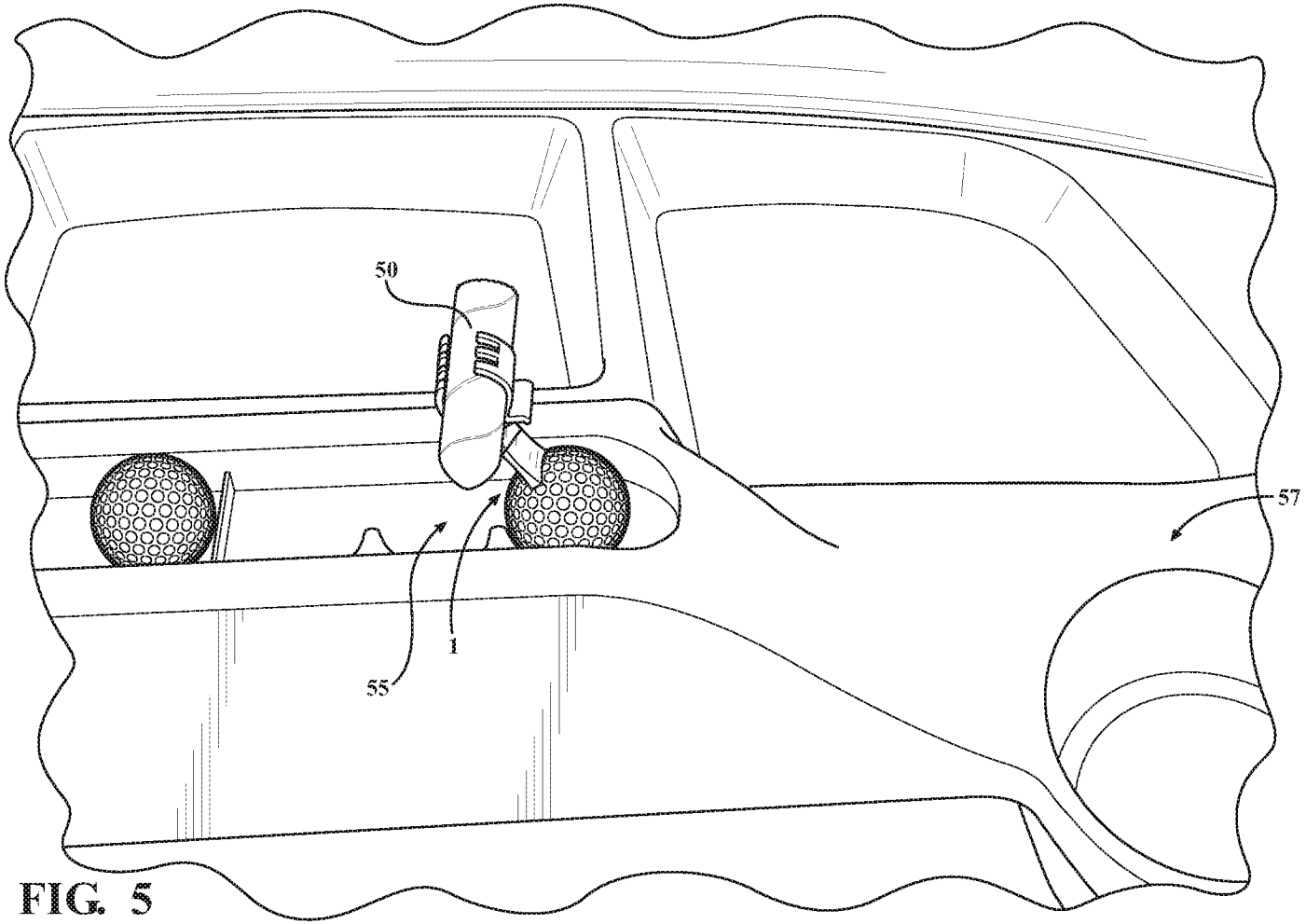
FIG. 5 shows the item holder in action holding a cigar and firmly seated into the ball bracket of a golf cart.

FIG. 5 shows the item holder assembly 1 in action holding a cigar 50 and firmly seated into the ball bracket 55 of a golf cart 57. The ball shaped portion 10 is suitably sized as discussed above to be press fit, but removably fit, into the ball bracket 55.

Figure 6:
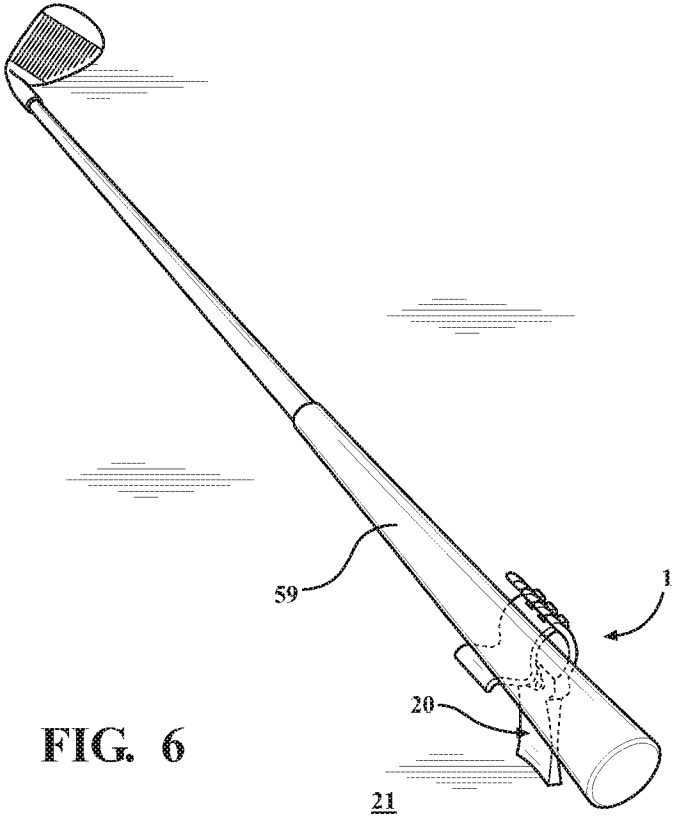
FIG. 6 shows the item holder in action holding a golf club grip above the wet turf.

FIG. 6 shows the item holder 1 holding a golf club 59 above the wet turf 62 by holding the grip portion above the turf 62, where the clip 20 is removed from the slot 29 of the ball shaped portion 10 and embedded in the turf 21 below the club 59. Although the golf club 59 could be held between the top clip element 24 and the bottom clip element 22 as is shown holding the cigar 50 in other Figures, in this depiction, the grip of the golf club 59 can be seated onto the actuator 25 and us the actuator 25 as a seat as a further alternative use of the clip 20.

Figure 7:
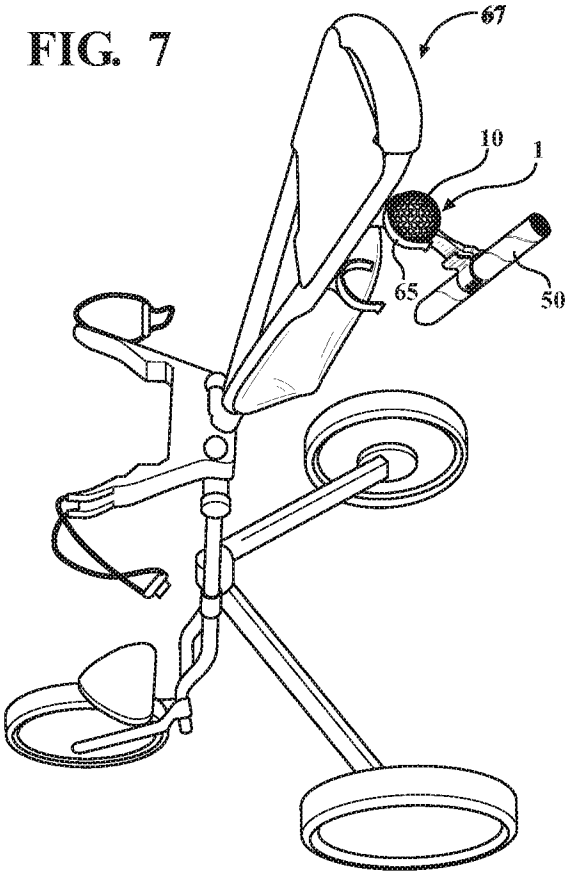
FIGS. 7 and 8 show the item holder holding a cigar and seated in the ball bracket of a pull cart.
Figure 8:
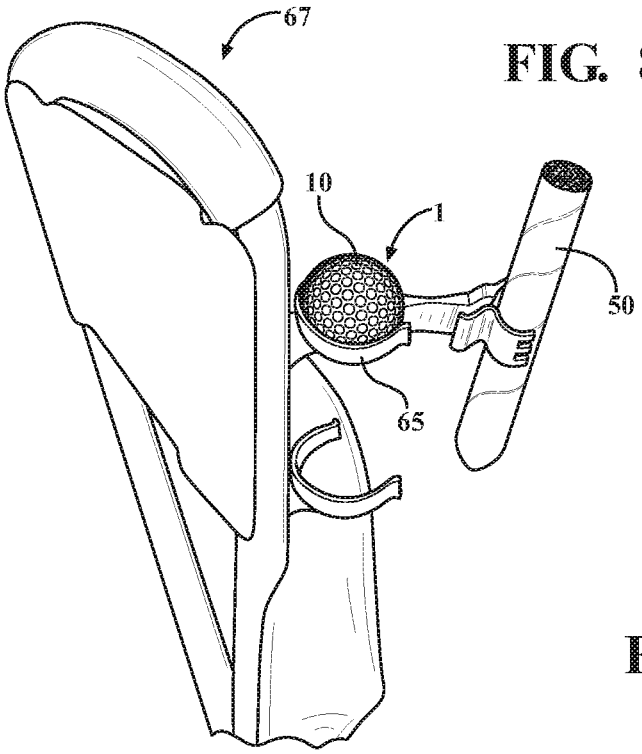

FIGS. 7 and 8 show the item holder assembly 1 holding a cigar 50 and seated in the ball bracket 65 of a pull cart 67. Again the ball shaped portion 10 is suitably sized as discussed above to be press fit, but removably fit, into the ball bracket 65.

Figure 9:
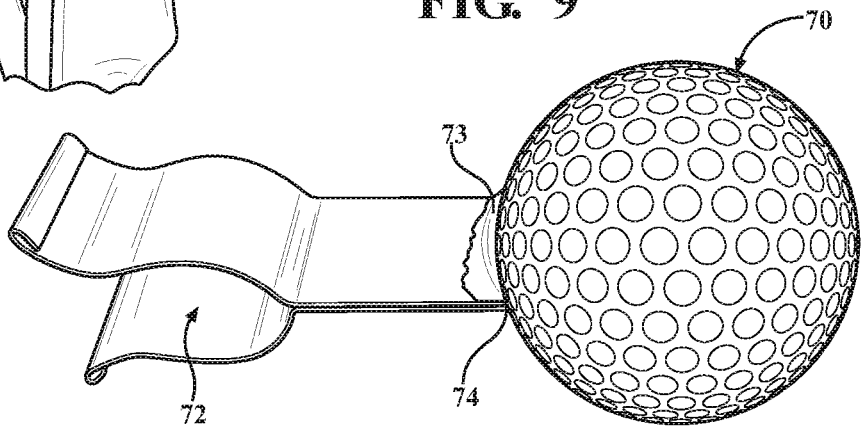
FIGS. 9, 10 and 11 show an alternate embodiment using an actual golf ball or equivalent and a holder fixedly attached to the ball via a slot in the ball.
Figure 10:
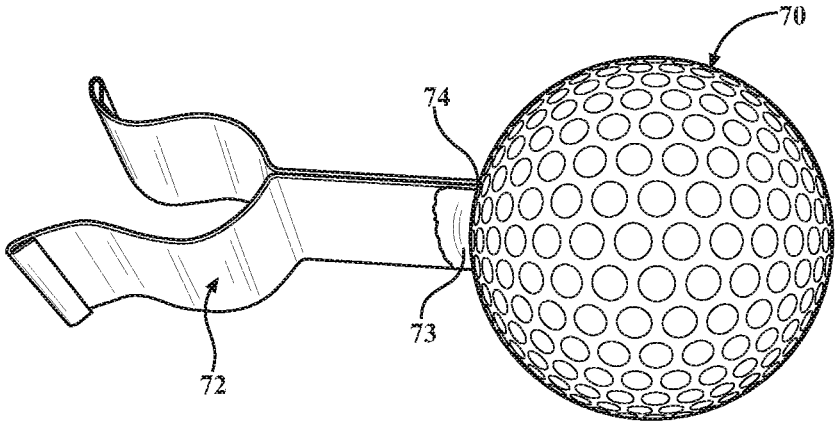
Figure 11:
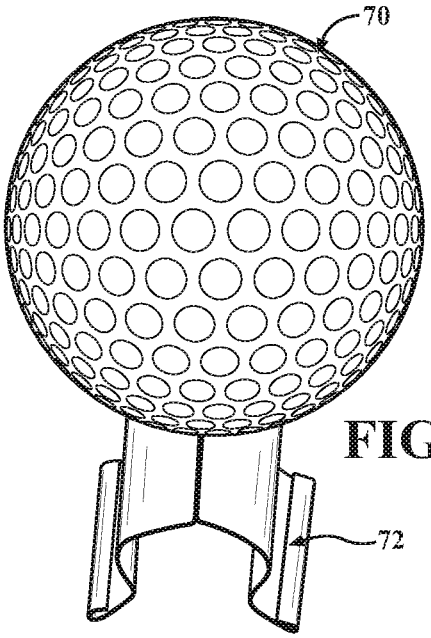
Figure 12:
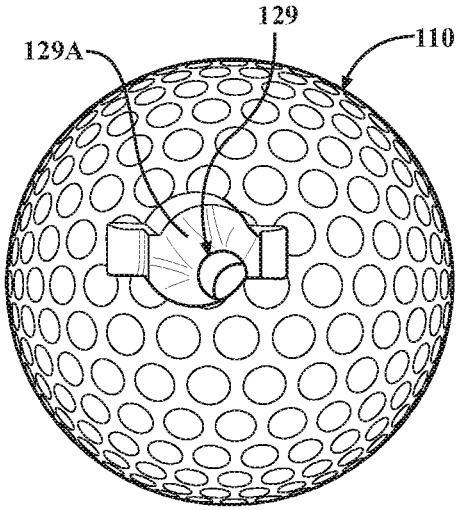
FIG. 12 depicts an alternate version of a spherical or ball shaped object that closely resembles an actual dimpled golf ball with a slot in it corresponding to a spike embodiment.

FIGS. 9, 10 and 11 shows an alternate embodiment using an actual golf ball 70 or equivalent and a cigar holder 72 fixedly attached to the ball by adhesive 73 via a slot 74 in the ball 70. The adhesive 73 is preferably disposed within the slot 74 of the ball 70. The adhesive 73 shown is an excess amount that may or may not exist in actual production.

Figure 13:
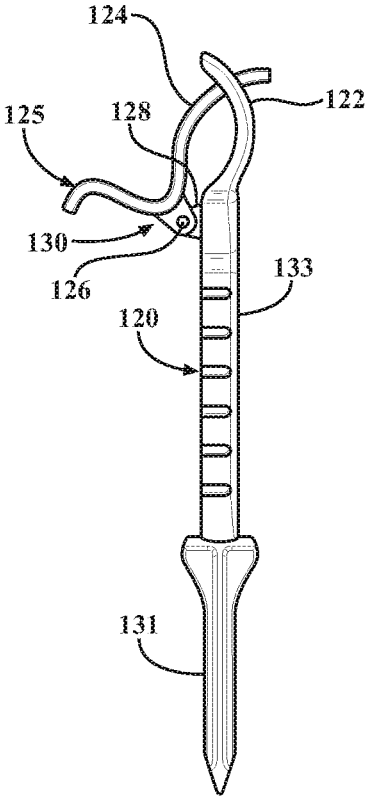
FIGS. 13, 14 and 15 show an alternate spike embodiment of a clip from three elevations: side, front, and rear views.
Figure 16:
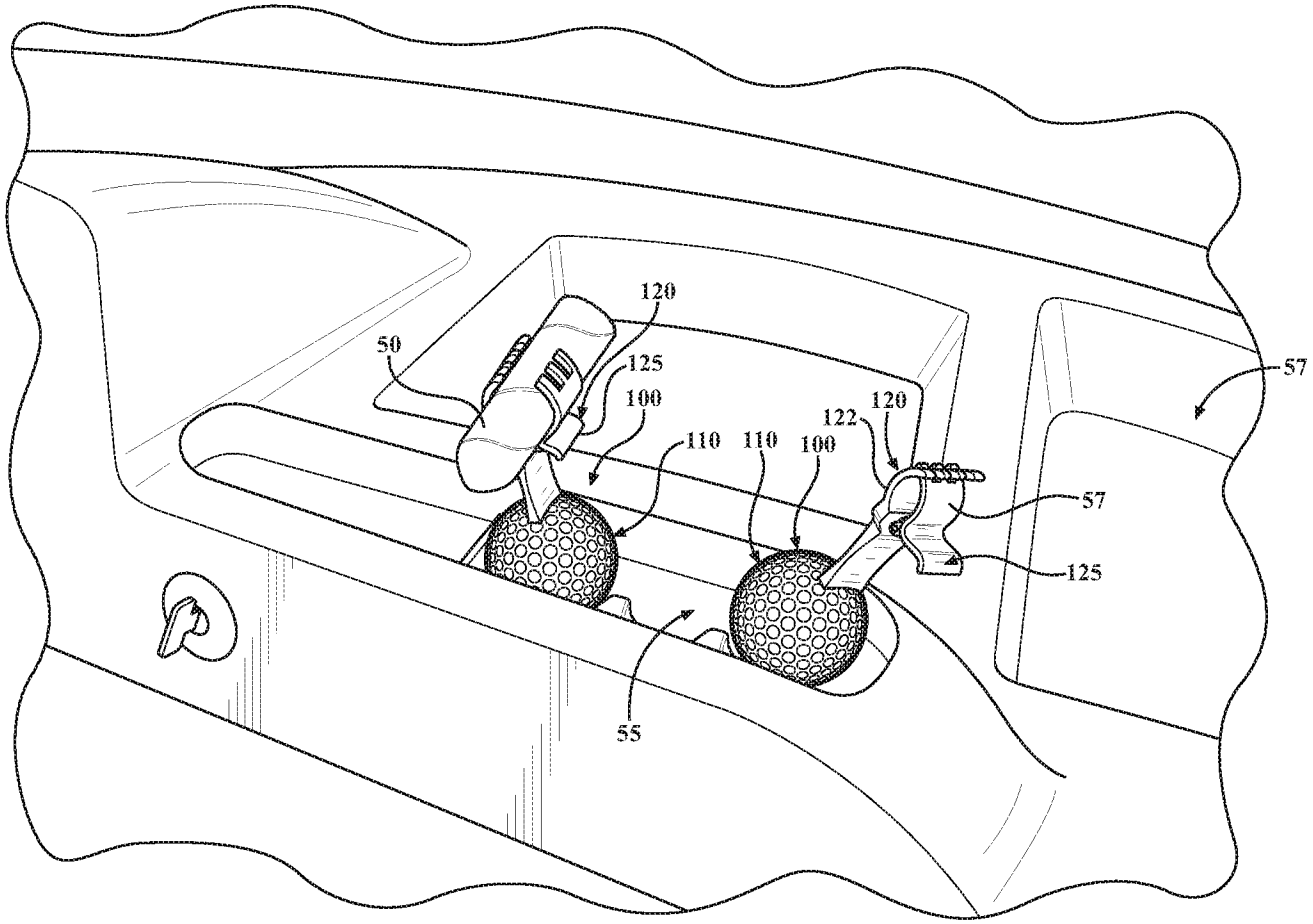
FIG. 16 shows two of the alternate embodiment assembly of FIGS. 12-15, as a full assembly of the spherical or ball shaped object and the clip, with one holding a cigar in the golf cart ball holder and one without holding a cigar.

A further alternate embodiment is shown in FIG. 12 through 18. Referring to FIG. 16 a full item holder assembly 100 is shown, having a spherical or ball shaped portion 110 (FIG. 12) and a clip 120 (FIGS. 13, 14 and 15), which are shown installed together in FIG. 16, including a bottom clip 122, a top clip 124, a hinge pin 126, and a hinge spring 128. Construction of the clip 120 involves aligning the top 124 and bottom 122 clips at the hinge 130, inserting the spring 128 between the bottom 122 and top 124 clips, and inserting the hinge pin 126 into the hinge 130, as illustrated in FIG. 13. The hinge 130 includes an actuator 125 manually engageable usually by the finger or a thumb of a user to open the hinge 130 to insert an item between the top 124 and bottom 122 clip elements. Release of the actuator 125 moves the top 124 and bottom 122 clip elements toward one another due to the bias of the spring 128 to hold an item between the top 124 and bottom 122 clip elements.

The clip 120 is inserted into a slot 129 in the ball shaped portion 110. The clip 120 includes a spike 131, which is preferably not exposed when the clip 120 is placed into the slot 129 of the ball shaped portion 110. The spike 131 has an outer surface configuration that corresponds with the inner surface 129A and conforms substantially to that surface 129A. The spike 131 may also be inserted into the ground as described below.

Figure 14:
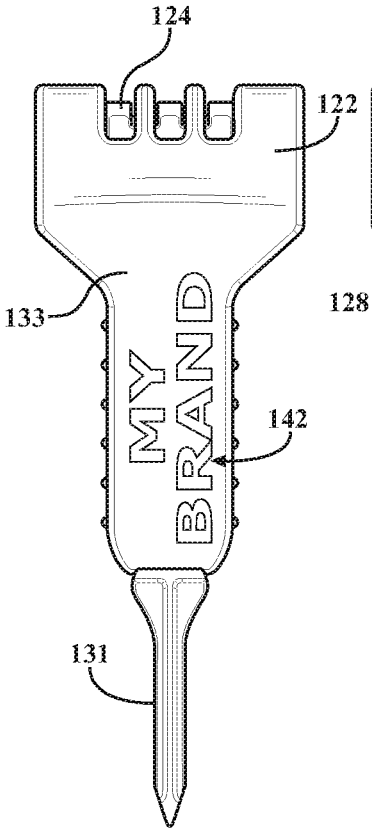
Figure 15:
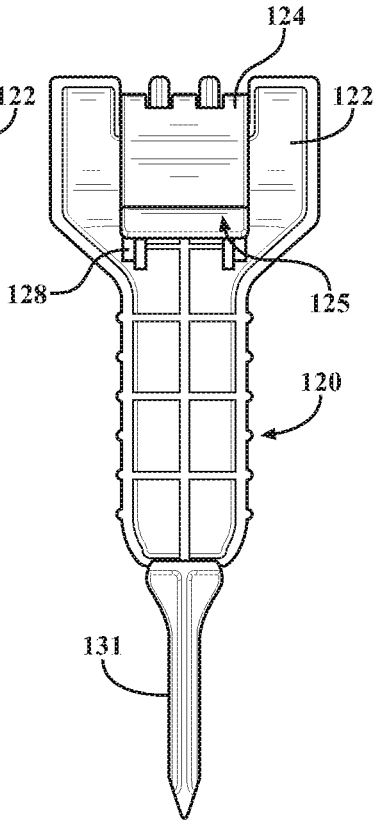

FIG. 14 shows surface portion 133 with consumer-defined lettering 142. As shown, the lettering 142 can be recessed into the body of the surface portion 133. Only the outline of the lettering is illustrated here. The actual production version of the surface portion 133 may have this lettering filled with a color different from the surface portion 133 and may be flush with the surface of that portion 133 to be used for a variety of advertising and marketing purposes.

Golf cart tee holders are designed for the standard golf tee, which is 4.5 mm in diameter. The spike 131 of the clip 120 adheres to this measurement and is preferred to be 4.5 mm in diameter. As such, the spike 131 will fit securely in the tee holder 139 of any golf cart equipped with this type of bracket as shown in FIG. 18.

Figure 17:
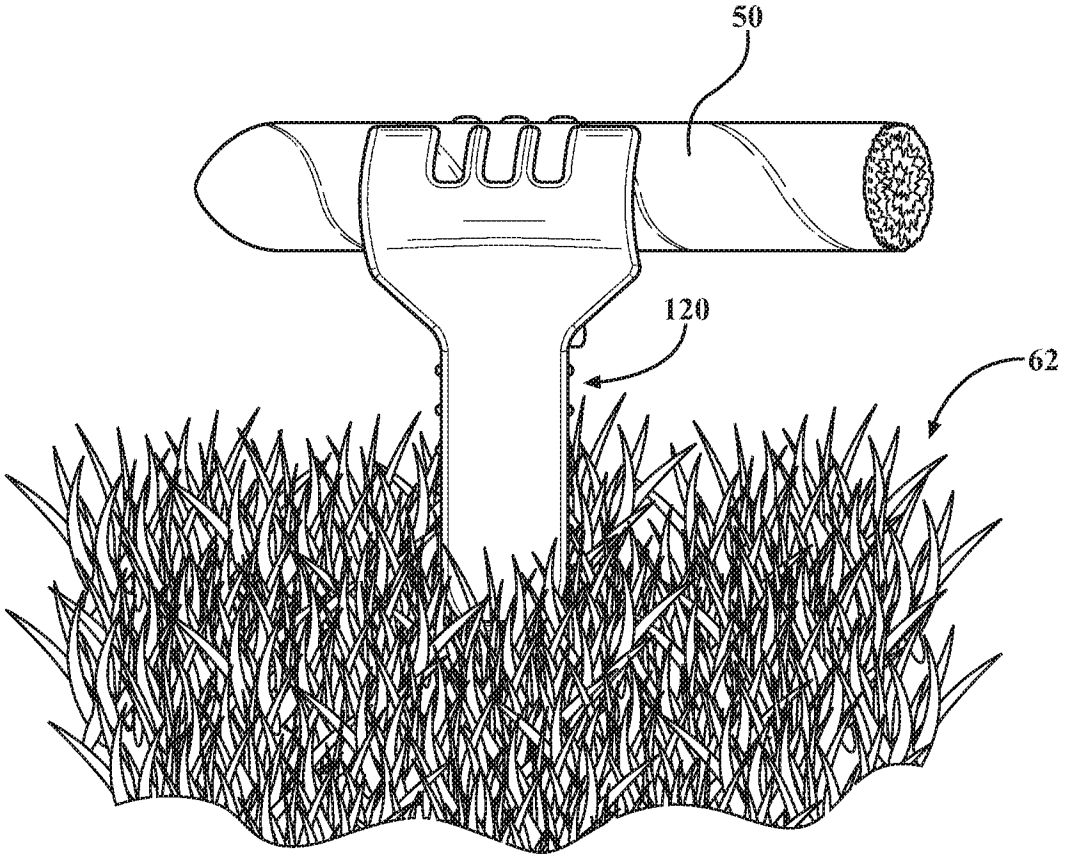
FIG. 17 shows the alternate embodiment assembly holding a cigar in the turf.
Figure 18:
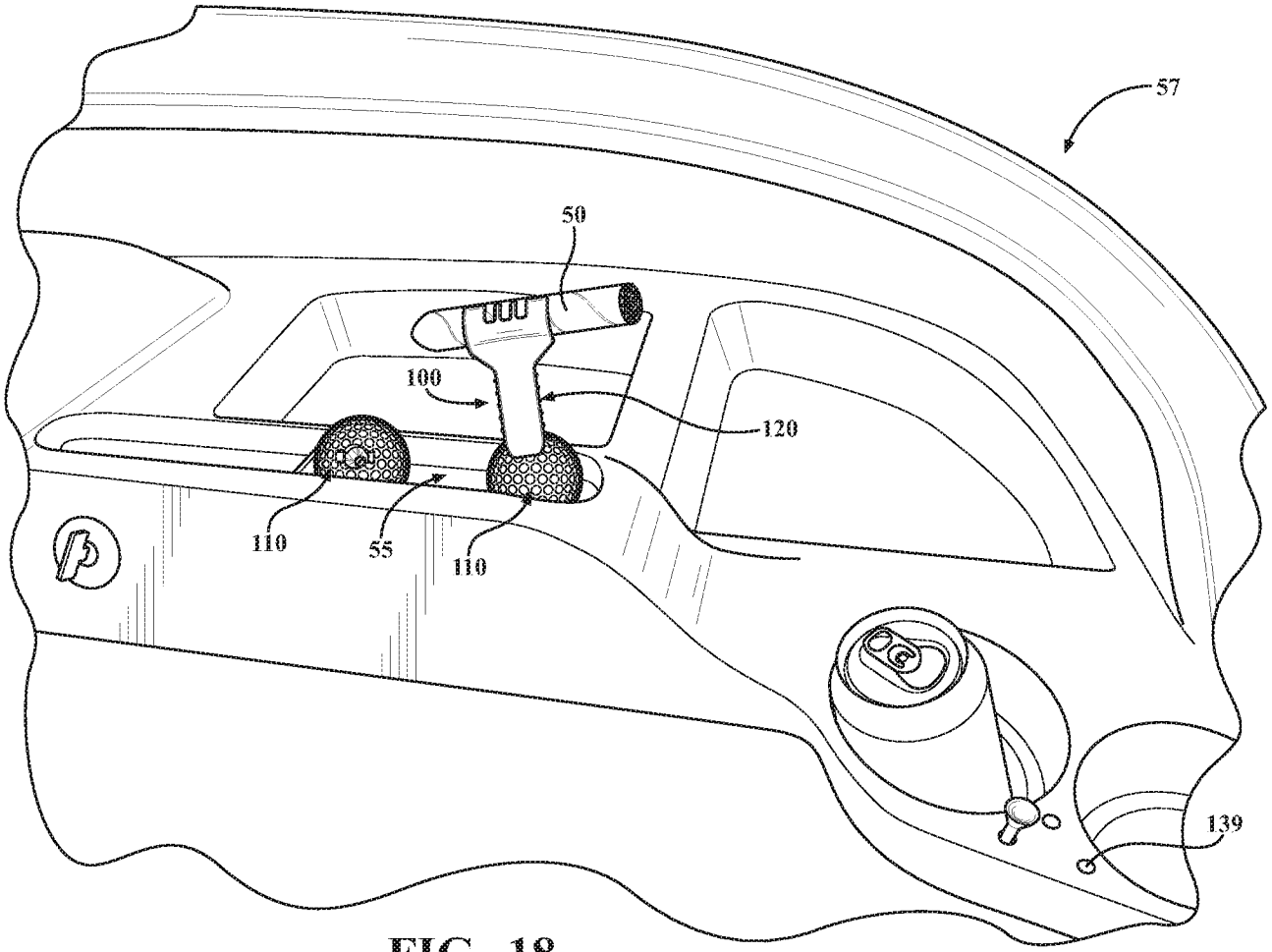
FIG. 18 shows two alternate embodiment item holders of FIGS. 12-16 in the cart ball holder, one holding a smoking cigar in the cart and the second one disassembled to use the clip in another manner such as holding a golf club off the turf or holding a second cigar off the turf.
Figure 19:
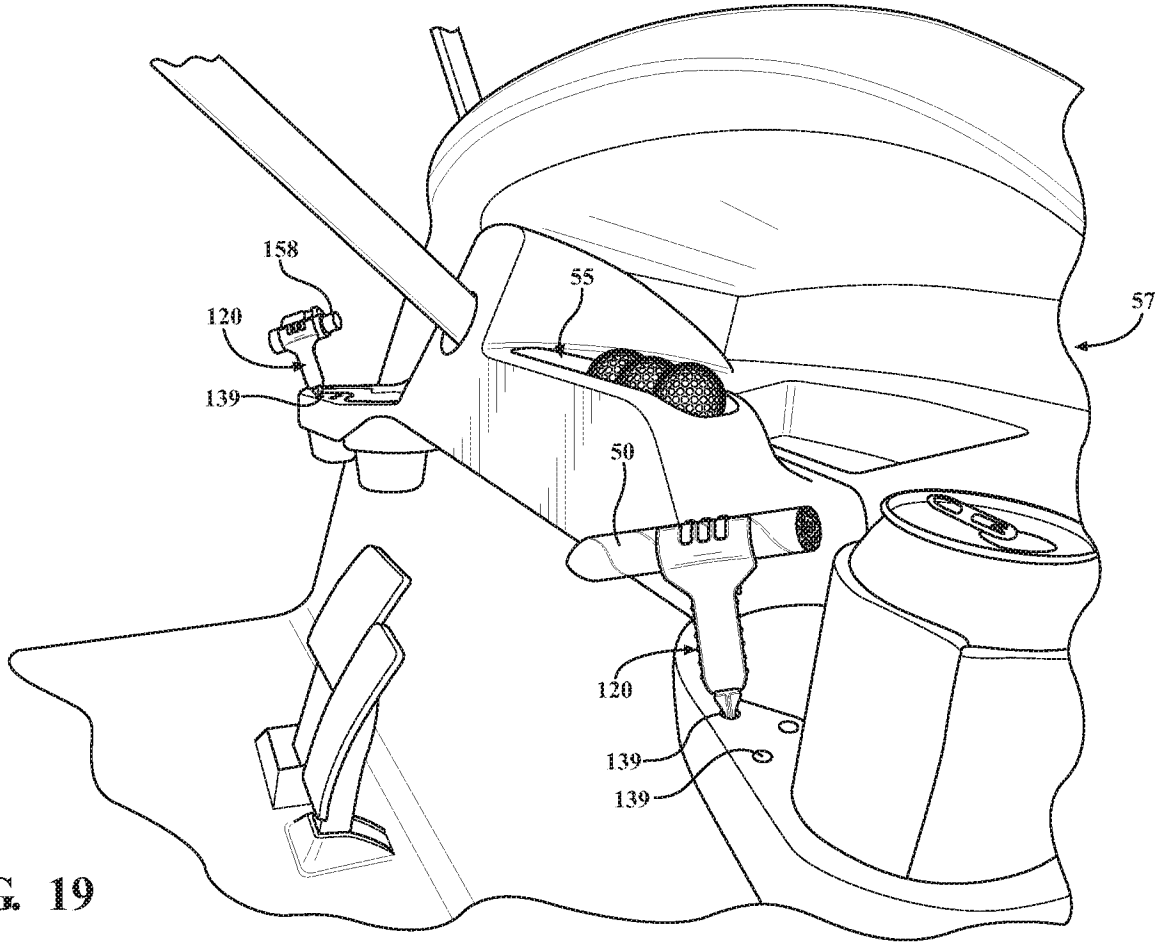
FIG. 19 shows a clip from the alternate embodiment holding a cigar in a golf cart's tee holder and holding another item, such as a lighter.

As shown in FIGS. 16 and 18, the item holder assembly 100 can be used to hold a cigar in a golf cart, while also using another item holder assembly for the same or a different purpose, such as holding another item such as a lighter 158 or other object. As seen in FIG. 17, the clip 120 can be removed from one of the assemblies 100 so that it could hold a cigar 50 in turf 62 or hold a club above the turf 62 as previously shown in FIG. 6. As shown in FIG. 19, the spike 131 can have independent utility in a golf cart tee holder 139 in a motorized golf cart, where one clip holds a cigar 50 and the other clip holds a lighter 158, but also could be used in a pull cart, motorized individual cart, scooter or whatever vehicle or thing is used to transport the golf clubs and/or the golfer around the golf course.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

The invention claimed is:

1. A device for supporting a cylindrical shaped object, the device comprising:
- a spherical shaped first element defining a slot; and
- a second element removably coupled to the first element, the second element comprising:
  - a clip including a top portion and a bottom portion, the combination of the top and bottom portions configured to removably secure the cylindrical shaped object to the clip;
  - a spike configured to engage the slot of the first element to removably couple the second element to the first element.

2. The device of claim 1, wherein the spike is shaped to fit within an aperture defined by a bracket in a golf cart for holding a golf tee such that the clip may be removably coupled to the golf cart via the aperture.

3. The device of claim 2, wherein said second element is removeable and replaceable in said spherical first element.

4. The device of claim 1, wherein the spike is shaped to define a tool for repairing indentations to turf on a golf course.

5. The device of claim 1, wherein said spike is configured for insertion into the ground when separated from the first element, such that the clip may be utilized to support the cylindrical shaped object above the ground.

6. The device of claim 1, wherein the clip further comprises a spring configured to bias the top and bottom portions towards one another.

7. The device of claim 1, further comprising a surface on one of the spherical first element or said clip for placement of custom lettering or a logo on said surface.

8. The device of claim 1, wherein the cylindrical shaped object supported by the clip comprises a smoking article.

9. The device of claim 1, wherein the cylindrical shaped object supported by the clip comprises a shaft of a golf club.

10. The device of claim 1, wherein said first spherical element is shaped for removable insertion within a recess defined in a golf cart.

11. The device of claim 1, further comprising a receiving element associated with a golf cart for said first spherical element.

12. The device of claim 11, wherein said receiving element is sized to releasably hold said spherical holding element.

13. A system for holding a cylindrical shaped object, the system comprising:

a spherical shaped portion defining a slot; and a clip including a top portion, a bottom portion, and a spike;

a bracket of a golf cart, the bracket shaped to receive said spherical shaped portion to removably couple the spherical portion to the golf cart;

wherein the spike is shaped to engage the slot to removably couple the clip to the spherical shaped element; and wherein the combination of the top and bottom portions of the clip are configured to removably secure the cylindrical shaped object to the clip element.

14. A method for holding a cylindrical shaped object, comprising the steps of:

placing a spherical shaped portion of an item holder into a bracket of a golf cart; and detaching a clip of the item holder from said spherical shaped portion by removing a spike of the clip from a slot in the spherical shaped portion.

15. The method of claim 14, further comprising the step of attaching the clip to a cylindrical shaped object by placing a portion of the cylindrical shaped object between a top portion and a bottom portion of the clip.

16. The method of claim 15, wherein the cylindrical shaped object is a smoking article.

17. The method of claim 15, further comprising inserting the spike into the ground to secure the cylindrical shaped object a distance from the ground.

18. The method of claim 15, further comprising reinserting the spike into the slot of the spherical shaped portion to removably secure the cylindrical shaped object to the golf cart.

* * * * *